United States Patent [19]

Wolff

[11] Patent Number: 4,964,831

[45] Date of Patent: Oct. 23, 1990

[54] COLLECTOR EDITION DOLL

[76] Inventor: Gustave F. Wolff, 3213 Hobcaw La., Lexington, Ky. 40502

[21] Appl. No.: 465,888

[22] Filed: Jan. 16, 1990

[51] Int. Cl.[5] ..... A63H 33/04; A63H 3/00; B32B 27/42

[52] U.S. Cl. ..... 446/75; 446/73; 446/268; 428/542.4

[58] Field of Search ..... 446/73, 72, 71, 74, 446/75, 76, 77, 79, 97, 98, 147, 148, 149, 268, 325, 321, 396, 390; 428/542.2, 542.4

[56] References Cited

U.S. PATENT DOCUMENTS

| | | | |
|---|---|---|---|
| 722,731 | 3/1903 | MacKaye | 446/310 X |
| 968,057 | 8/1910 | Iwata | 446/310 X |
| 1,606,354 | 11/1926 | Fillion | 446/72 X |
| 2,538,085 | 1/1951 | Cotton | 446/149 X |
| 3,520,078 | 7/1970 | Klamer | 446/73 |
| 3,597,877 | 8/1971 | Speers | 446/72 |
| 4,176,473 | 12/1979 | Rae | 446/147 X |
| 4,795,397 | 1/1989 | Stevens | 446/390 X |
| 4,836,821 | 1/1989 | Raymond | 446/310 X |
| 4,865,097 | 9/1989 | Allen | 446/268 X |
| 4,905,828 | 3/1990 | Dods | 446/75 X |

*Primary Examiner*—Robert A. Hafer
*Assistant Examiner*—D. Neal Muir
*Attorney, Agent, or Firm*—King & Schickli

[57] ABSTRACT

A collector edition doll includes an outer casing having a painted face depicting an event or events in the life of the doll. A pedestal for the casing is also provided. The doll, casing and pedestal are all hand-crafted. More particularly, they are carved from wood and hand-painted so that each is unique in its own right. Additionally, each doll comes with a story sheets which details events in the life of the doll and, particularly, that event depicted on the painted face of the casing.

7 Claims, 2 Drawing Sheets

COLLECTOR EDITION DOLL

TECHNICAL FIELD

The present invention relates generally to a unique article of manufacture and, more particularly, to a collector edition series of dolls which are uniquely packaged in a hand-painted wooden case.

BACKGROUND OF THE INVENTION

There is a great deal of interest in dolls and particularly dolls which are hand-crafted. Such dolls are sought by collectors and have the potential of becoming quite valuable over time. Many people amass large collections of unique ceramic dolls or antique carved wood dolls.

The present invention relates to a unique collector edition series of dolls. The dolls are hand-crafted and carved from wood stock. They are then hand-painted to provide a high quality collectible with no two dolls looking exactly alike.

The dolls are also distributed in a decorative casing which is also hand-crafted and painted. Each of the casings includes a finish and painting which exhibits the "old world" craftsmanship so valued by collectors.

SUMMARY OF THE INVENTION

Accordingly, it is a primary object of the present invention to provide a collector edition doll of superb craftsmanship.

Another object of the present invention is to provide a collector edition doll including an outer casing, in which the doll may be exhibited, having a painted face depicting an event in the life of the doll.

Yet another object of the present invention is to provide a collector edition doll and case for the doll wherein both the doll and case are hand-crafted and wherein a story sheet is provided detailing events in the life of the doll including an event as depicted on the painted face of the casing.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, a collector edition doll is provided. The doll is received in an outer casing, that may be used for both storage and display, which includes a painted face. A story sheet is also received with events in the life of the doll. The story sheet details More preferably, the story sheet details at least one event which is hand-painted on the face of the casing. In this way the doll is given an individual identity and personality which increases its attractiveness to collectors.

Additionally, a pedestal means is provided. The pedestal may be received within the casing and serve, for example, as a table for the doll or alternatively used to support the casing during display.

Preferably, the doll, pedestal and casing are all hand-crafted by artisans. More particularly, the doll and outer casing are carved from wood. For example, the casing may be substantially spherical in shape and formed by two halves that are joined together. The casing includes a smooth finish which is hand-painted to depict, for example, a scene of various tall ships in sail.

The doll which is carved from wood includes clothing cut from cloth and a hand-painted, expressive face. Silk, cotton or other natural or synthetic materials may be utilized to make the clothing which is hand cut and sewn. The pedestal is also carved by hand. In all, the collector edition doll as well as the outer casing and pedestal are all of the highest quality and hand-crafted by artisans with attention to detail to give it the "old world" feel highly prized and sought by collectors.

Still other objects of the present invention will become readily apparent to those skilled in this art from the following description wherein there is shown and described a preferred embodiment of this invention, simply by way of illustration of one of the modes best suited to carry out the invention. As will be realized, the invention is capable of other different embodiments and its several details are capable of modifications in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
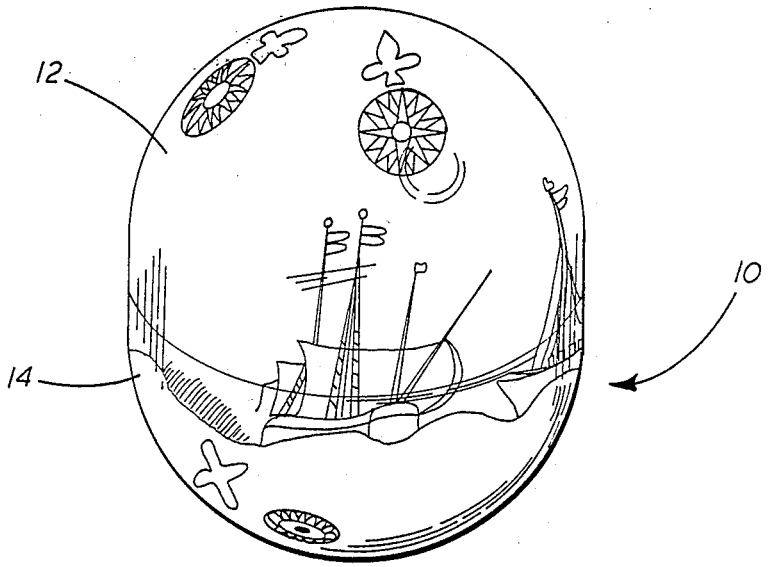
FIG. 1 is a perspective view of a casing for holding the collector edition doll of the present invention.

Reference is now made to FIGS. 1–4 showing an example of a collector edition doll of the present invention. As best shown in FIG. 1, the doll of the present invention includes an outer casing which is substantially spherical in shape. Preferably, this casing is hand-crafted from wood. More particularly, the casing 10 includes upper and lower halves 12, 14 that may be securely joined together by means of the flange 16.

Figure 4:
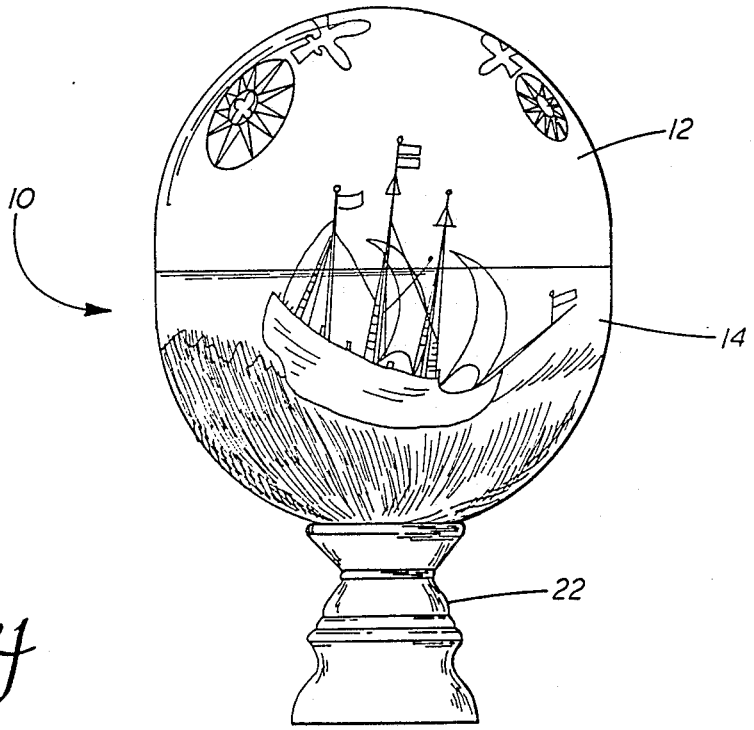
FIG. 4 is a side elevational view showing the casing with both halves joined together positioned on the pedestal for display.

Both the upper and lower halves 12, 14 of the casing 10 may be hand-carved and provided with an exceedingly smooth finish. A face of the outer casing 10 is hand-painted with one or more scenes depicting one or more events in the life or lives of the doll or dolls 18, 20 contained therein (note also FIG. 2). For example, as best shown in FIGS. 1 and 4, the outer casing 10 may include a painting showing various tall ships at sail on the ocean. Various seals and graphics may also be provided to relate an "old world" look and feel to the casing.

Figure 2:
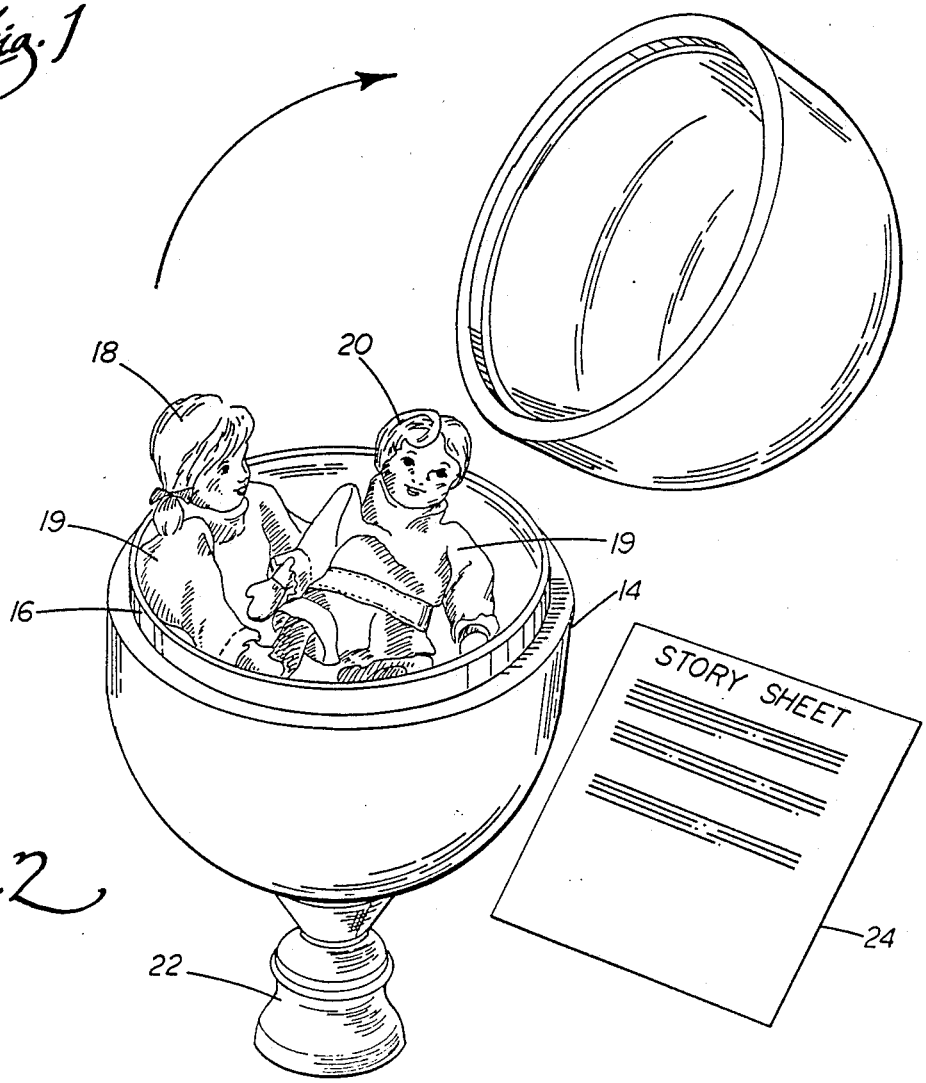
FIG. 2 is a perspective view of the casing shown in FIG. 1 with the casing opened and positioned on a pedestal to display two dolls and a story sheet detailing events in the life of the dolls.

Also contained within the casing 10 shown in FIG. 1 is a pedestal 22. When positioned within the casing 10 with the dolls 18, 20, the pedestal 22 provides the appearance of a table around which the dolls are seated. When removed from the casing 10, the pedestal 22 may be positioned beneath the casing to hold it firmly in an upright position (note FIGS. 2 and 4). More particularly, the casing 10 may be positioned on this pedestal 22 with the upper half 12 removed to display the dolls 18, 20 sitting in the lower half 14 as shown in FIG. 2. Alternatively, the entire casing 10 may be joined together and positioned on the pedestal 22 as shown in FIG. 4 to display the hand-painted scene on the face of the casing. Of course, in order to securely hold the casing 10 in position, the pedestal 22 is provided with a substantially concave upper surface which prevents the casing from rolling from the pedestal.

Figure 3:
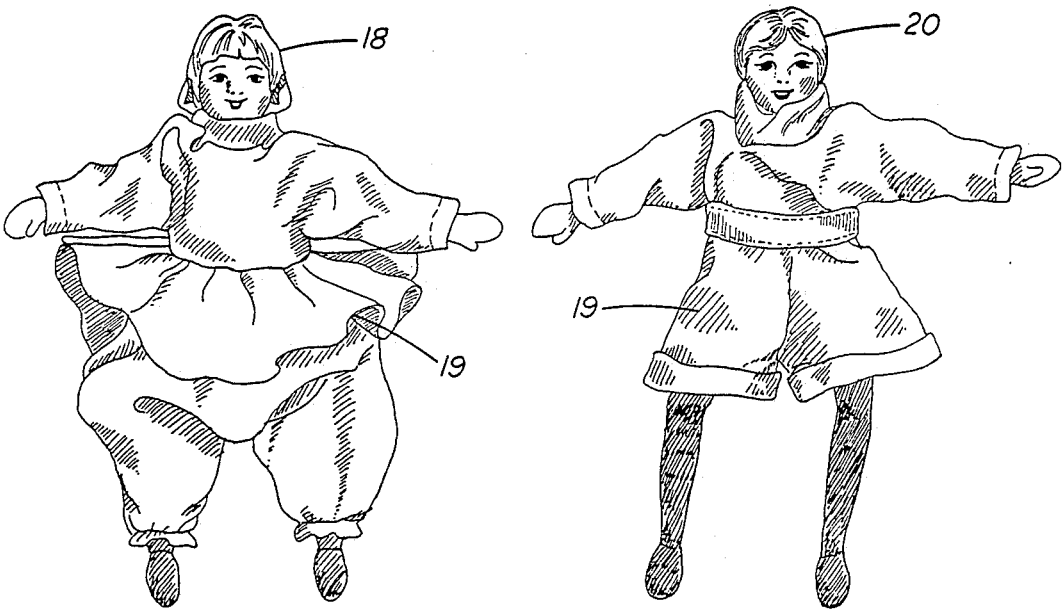
FIG. 3 is a front elevational view showing the two dolls depicted within the lowef half of the casing in FIG. 2.

As should also be appreciated, each of the dolls 18, 20 is carved from wood. Intricate detail with respect to the shaping of the face and hair is provided. Additionally, the actual facial features are hand-painted so that each doll 18, 20 has its own unique look and personality. As best shown in FIG. 3, the dolls 18, 20 are also outfitted in clothing 19 cut from various types of cloth such as cotton and silk. Other natural and synthetic materials may, however, also be utilized. Preferably, the clothing 19 is hand cut and sewn to again provide that craftsmanship and unique detail which collectors value so highly. As shown in FIG. 3, the clothing 19 is preferably of a style which would be worn at the time of at least one event depicted in the painting of the outer casing. Thus, female and male dolls 18, 20, respectively, are shown in period travel dress (see FIG. 3) as would be expected to be worn while sailing on a tall ship.

As also shown in FIG. 2, a story sheet 24 is provided and packaged in the casing 10 with the dolls 18, 20 and pedestal 22. Preferably, the story sheet 24 is written in old style lettering or calligraphy and provides details of the lives of the dolls 18, 20. More particularly, the story sheet 24 provides details of the events depicted in the painting shown on the casing 10. In this way, the story sheet 24 serves to unite the dolls 18, 20 and the casing 10 together and provide an individual entity and personality to the dolls through the text of the story sheet and the depiction of the event or events in the painting of the casing 10. Advantageously, this serves to allow collectors and others to quickly identify with the dolls 18, 20 and as such improves their appeal. For example, the story sheet 24 for the dolls 18, 20 in the casing 10 depicted in the drawing figures would provide details of the trip from Europe to the New World in the Americas.

In summary, numerous benefits have been described which result from employing the concepts of the present invention. The unique collector edition dolls 18, 20 of the present invention are made by artisans and hand-crafted of a quality rarely seen today. Together, the dolls 18, 20, the dolls' clothing 19 and the painting on the outer casing 10 work with the story sheet 24 to provide an identity and character to each doll. In this way the dolls 18, 20 are each given a unique personality that allows children and collectors alike to more quickly identify with the dolls and thus makes them more attractive to own.

The foregoing description of the preferred embodiment of the invention has been presented for purposes of illustration. It is not intended to be exhaustive or to limit the invention to the precise form disclosed. Obvious modifications or variations are possible in light of the above teachings. For example, an entirely different scene in the life of one or more dolls 18, 20 may be provided in the painting of the casing 10 and new or additional stories relating to those scenes could be provided for each doll as the doll grows through life from childhood to old age. Additionally, the casing could also be used to house something other than dolls such as a musical movement.

The preferred embodiment was chosen and described to provide the best illustration of the principles of the invention and its practical applications to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A collector edition doll, comprising:

an outer casing including a painted face;

a doll received in said casing;

a story sheet received within said casing and detailing events in the life of said doll; and pedestal means that may be received within said casing or alternatively used to support said casing.

2. The collector edition doll set forth in claim 1, wherein said story sheet details an event which is hand-painted on a face of said casing.

3. The collector edition doll set forth in claim 1, wherein said outer casing is made of wood.

4. The collector edition doll set forth in claim 1, wherein said outer casing is substantially spherical in nature.

5. The collector edition doll set forth in claim 4, wherein said outer casing includes two halves that may be joined together.

6. The collector edition doll set forth in claim 4, wherein said painted face of said casing is hand-painted and depicts various tall ships in sail.

7. The collector edition doll set forth in claim 1, wherein said doll is carved from wood and includes clothing cut from cloth and a hand-painted face.

* * * * *